United States Patent [19]

Feess et al.

[11] 4,057,389

[45] Nov. 8, 1977

[54] PROCESS FOR THE PRINTING WITH DEVELOPING DYES

[75] Inventors: Erich Feess, Lorsbach, Taunus; Willy Grönen, Kelkheim, Taunus, both of Germany

[73] Assignee: Hoechst Aktiengesellschaft, Frankfurt am Main, Germany

[21] Appl. No.: 674,286

[22] Filed: Apr. 6, 1976

[30] Foreign Application Priority Data

Dec. 20, 1975 Germany ..... 2557554

[51] Int. Cl.[2] ..... C09B 27/00; C09B 45/48; D06P 3/12

[52] U.S. Cl. ..... 8/71; 8/44; 8/46; 8/54.2; 8/62; 8/70; 8/92

[58] Field of Search ..... 8/46, 71, 44, 70, 92, 8/54.2

[56] References Cited

U.S. PATENT DOCUMENTS

| | | | |
|---|---|---|---|
| 2,597,306 | 5/1952 | Eaton | 8/71 |
| 3,000,298 | 9/1961 | Bryant | 101/129 |
| 3,494,716 | 2/1970 | Hoffman | 8/21 |
| 3,787,179 | 1/1974 | Lowenfeld | 8/45 |
| 3,961,886 | 6/1976 | Hertel et al. | 8/44 |

FOREIGN PATENT DOCUMENTS 638,878 11/1936 Germany.

*Primary Examiner*—A. Lionel Clingman
*Attorney, Agent, or Firm*—Curtis, Morris & Safford

[57] ABSTRACT

Cellulosic material is printed with a paste containing the alkaline solution of a coupler, the dispersion of a diazotable aromatic amine, a nitrite and a thickener, and the dyestuff is developed on the fiber by adding solutions of organic acids and, after a short air passage, contacting the dyeing or print with an alkaline agent.

16 Claims, No Drawings

PROCESS FOR THE PRINTING WITH DEVELOPING DYES

The present invention is a modification to and an improvement in the process disclosed in copending U.S. Patent application Ser. No. 623,338 filed Oct. 17, 1975 by Feess et al.

The above-cited copending Application relates to a process for the printing of cellulosic textile material with developing dyes by applying onto the untreated material a printing paste which contains a. an alkaline solution of a coupling component suitable for the printing with developing dyes,
b. a dispersion of an amine suitable for the preparation of developing dyes,
c. sodium nitrite, and
d. a printing thickener, and developing the dyestuff on the fiber either by acidic steaming or by applying a dilute aqueous solution of an organic acid having a minimum solubility in water of 30 g per 100 g of water, a pK value of from 4.0 to 2.5 at 20° C, and a boiling point, at normal pressure, which exceeds 175° C, and finally steaming the material with neutral steam or drying it rapidly. The said process provides level and brilliant prints and is distinguished by a great simplicity and variety of coloration possibilities as compared to the known conventional common application of coupling components and amines in the printing paste.

In modification of the said process, it has now been found that the formation of the dyestuff (diazotization and coupling) on the fiber can be brought about after the treatment with a dilute aqueous solution of an organic acid and after a short passage through the air of preferably from 0.5 to 3 minutes, in particular from 1 to 2 minutes, by contacting the material with an alkaline agent.

The advantages of this new process are, on the one hand, that the dyestuff can be formed at room temperature, without using any heat at all, and on the other hand, that the subsequent passage through an alkaline medium also allows amines to be used as diazo components which require higher pH-values for coupling, i.e. ranging from 7 to 8, thus opening new ways especially in the production of blue shades.

Preferable embodiments of this invention are illustrated in the following:

As coupling components to be used for this process, besides low-substantivity or medium-substantivity aryl amides of acetoacetic acid, of 2-hydroxy naphthalene-3-carboxylic acid or of heterocyclic o-hydroxy-carboxylic acids may be mentioned, especially, 2-hydroxy-naphthalene-3-carboxylic acid phenylamide and the derivatives thereof which carry lower alkyl or lower alkoxy groups (of 1 to 4 carbon atoms) or halogen atoms in the phenylamide radical, such as 2-hydroxy-naphthalene-3-carboxylic acid-(2'-methyl-phenyl-1')-amide, 2-hydroxy-naphthalene-3-carboxylic acid-(2'-ethoxy-phenyl-1')-amide or 2-hydroxy-naphthalene-3-carboxylic acid-(4'-chloro-6'-methoxyphenyl-1')-amide.

As amines, there may be used, in addition to nitroanilines, 2-nitro-aniline, 3-nitro-aniline, 4-nitro-2-amino-anisole, 5-nitro-2-amino-anisole, 5-nitro-2-amino-toluene or 5-nitro-4-amino-anisole; amino-carboxylic acid amides, especially benzoic acid amides which may be substituted, such as 5-amino-4-methoxy-benzoic acid amides; amino-sulfonic acid amides, especially benzene acid amides which may be substituted, such as 2-amino-anisole-4-sulfonic acid diethylamide, aminonitriles, especially benzonitriles which may be substituted, such as 2-amino-2,5-dimethoxy-4-benzonitrile; benzoyl phenylene diamines, which may be substituted, such as 1-amino-4-benzoylamino-2,5-diethoxy-benzene or 2-amino-4-methyl-5-benozylaminoanisole; diamino-diphenyls, such as o-toluidine or dianisidine, especially the diazo components of 4-amino-diphenyl-amine and its lower alkyl- or lower alkoxy-substituted products, which are important for the production of blue shades, preferably 4-amino-3-methoxy-diphenylamine.

The phrase "which may be substituted" implies substitution by one or more identical or different substituents selected from alkyl or alkoxy of 1 to 4 carbon atoms, chlorine and bromine; the term "lower" means aliphatic groups of 1 to 4 carbon atoms.

The dispersions of amines required for the new process may be prepared by various methods which are known:

For example, adequate dispersions may be obtained by grinding an amine in an aqueous suspension, advantageously in the presence of a dispersing agent, to avoid formation of agglomerates; the grinding operation may be run in a roller or vibratory mill filled with balls; especially usefull are ball mills provided with stirrers and filled with glass beads or natural sand. Fine division using a so-called dissolver often also leads to useful results.

It is also possible to mix with water a solid composition that has been prepared by spray-drying a base dispersion containing a solid dispersing agent or by grinding a mixture of a solid dispersing agent and an amine, for example in a pin mill. Suitable dispersions may also be obtained by blending a solution of an amine and a suitable dispersing agent in a water-soluble solvent with water or the printing paste. If the dispersing agent is liquid and has a sufficiently high dissolving power for the amine, a particular solvent need not be used.

The dispersing agents used may be of anionic or non-ionic nature and belong, for example, to the following classes of substances:

Long-chain alkyl sulfonates, alkylaryl sulfonates, aryl sulfonates, lignin sulfonates, sulfonated cresol-formaldehyde resins, condensation products of formaldehyde and naphthalene sulfonic acids, alkanoyl amino-sulfonic acids, alkyl polyglycol ethers, alkylaryl polyglycol ethers, aryl polyglycol ethers, or acyl polyglycol esters.

The dispersions consist of from about 25 to 60% of base and from about 4 to 15% of the dispersing agent. In addition, they may contain an agent, such as glycol or glycerol, to prevent freezing or drying, or a fungicidal agent, such a pentachlorophenol, to suppress potential formation of mould during a prolonged period of storage.

The so-called average particle size (according to RAMLER-ROSIN; (Chemie Ingenieur Technik 36/1964) 523 et seq.) should be 0.002 mm or less in order to ensure satisfactory prints according to the invention, as far as color intensity (tinctorial strength) and uniformity are concerned.

As printing thickeners, any thickener which is resistant to alkali and of low solids content may be used, for example locust bean flour ether thickeners.

The printing pastes may also contain conventional printing aids such as glycerol, diglycol or dihydroxydiethyl sulfide. In addition to the components for the developing dyes, the printing pastes may also contain soluble leuco sulfuric acid ester vat dyes which permit a further increase in the coloration possibilities.

In the so-called Africa print, this possibility opens up completely new prospects since, for example with an addition of Sol. Vat Blue 1, C.I. No. 73002, it is possible in a simple manner to produce a strikingly resembling imitation of indigo which is preferably used for the Africa printing and in the batik industry.

The composition of the printing pastes of this invention corresponds to that disclosed for the composition as given in the above-cited copending application.

As acids to be used for developing the dyes on the fiber, all the organic monohydroxy monocarboxylic acids, dihydroxy dicarboxylic acids, monohydroxy tricarboxylic acids or halocarboxylic acids which have a water-solubility of at least 30 g in 100 g of water, a pK value of from 4.0 to 2.5 at 20° C and, at normal pressure, a boiling point of more than 175° C are suitable, for example lactic acid, glycolic acid, tartaric acid, citric acid or monochloroacetic acid, as well as mixtures thereof.

These acids are preferably transferred onto the preliminarily printed and dried textile material in an amount of from 50 g/l to 300 g/l of water, especially 100 g to 200 g/l of water, by padding, slop-padding, spraying or cross-printing with the help of an entirely engraved stipping roller or a full-printing screen, and they may optionally contain additives, preferably from 100–200 g/l of sodium chloride or of sodium sulfate.

Diazotization and coupling which yield the final dyestuff set in spontaneously and almost at the same time, so that — in the simplest case — a continuous air passage of from 40 to 90 seconds would be sufficient to complete the development of the dye. In the case of slow-reacting coupling components, especially in the production of blue shades on the basis of 4-aminodiphenyl-amine and the aforesaid substitution products thereof, the process of the invention requires an additional passage through an alkaline medium, after the air passage, to reach the optimum coupling pH-value of from 7 to 8, for example by passing the acid material, after the air passage, at open width through a bath having a preferable temperature of from 70° to 80° C and preferably containing from 10 to 15 g/l of sodium carbonate (anhydrous). In such a bath, the coupling component is then coupled even with as slow-coupling a diazonium compound as 4-amino-diphenylamine or a substitution product thereof. The material is then rinsed and soaped as usual. It is, of course, also possible to use other alkaline agents, for example trisodium phosphate or ammonia or a sufficiently volatile and basic organic amine, which may also be employed as a gas. In this latter case, the passage through an alkaline medium then comprises, for example, passing the material through a box containing a concentrated aqueous ammonia solution.

This new process, too, provides level and brilliant prints and is distinguished by a great simplicity compared with the conventional printing methods using developing dyes, owing to the single-step common use of coupling components and an amine as the diazo component in the printing paste. Moreover, the possibility of using two or more coupling components or amines at the same time offers a great variety of colorations.

Methods for the printing of textile material with mixtures of coupling components and soluble bases are already known. For example, according to the process disclosed in German Patent Specification No. 638,878, the dyestuff is also developed by passing it through an acid bath and then neutralizing it by a passage through an alkaline bath. In German Patent Specification No. 661,225, this passage through an alkaline bath is replaced by a slow drying operation during a prolonged exposure to air or by a thorough rinsing; German Patent Specification No. 663,496 proposes a treatment with basic vapors instead. All those patents mainly propose mineral acids, preferably hydrochloric acid, for the passage through the acid bath.

The most substantial difference and the most striking advantage over the cited state of the art are the use of dispersed bases of a specific particle size, which allows printing pastes of an almost unlimited stability to be prepared, and the simultaneous use of several coupling components or amines in the printing paste, which offers additional coloration possibilities, quite apart from the fact that such operations as prolonged "exposure to air" or "slow driving" are hardly suitable for a continuous production.

The following Examples illustrate the invention, the parts and percentages being by weight unless stated otherwise. The dyes used in the Examples have been taken from the third edition (1971) of the Colour Index. Parts, ratios and percentages are by weight (if not specified otherwise).

EXAMPLE 1

20 Parts of 2-hydroxy-naphthalene-3-carboxylic acid-(2'-methyl-phenyl)-amide (C.I. No. 37 520) were mixed while stirring with a mixture of 25 parts of ethanol, 30 parts of $\beta,\beta'$-dihydroxy-diethyl-sulfide and 20 parts of 33% sodium hydroxide solution, and the mixture was dissolved by adding 100 parts of water of 60° C. Then, 20 parts of a 40% aqueous dispersion of 4,4'-diamino-3,3'-dimethoxy-diphenyl (C.I. No. 37 235), containing 15% of a lignin sulfonate as a dispersing agent, were diluted with 80 parts of water.

With 400 parts of a 5% aqueous thickener of a locust bean flour ether, diluted with 250 parts of water, first the naphthol solution, then the dilute amine dispersion and finally a solution of 20 parts of sodium nitrite in 40 parts of water were stirred.

With this printing paste, a bleached and mercerized cotton fabric was printed on a roller printing machine and dried. Then the material was impregnated with an aqueous cold 10% solution of monochloro-acetic acid at a liquor pick-up of 75% on a two-roller padding machine and after having been passed through air for 2 minutes, it was passed through a bath of 70° C containing 10 g/l of anhydrous sodium carbonate.

It was then rinsed as usual with cold and hot water, washed in hot water, rinsed again with hot and cold water and finally dried. A full dark-blue print of high tinctorial strength was obtained that showed the fastness properties usual for a combination of C.I. No. 37 520 / C.I. No. 37 235.

EXAMPLE 2

20 Parts of 2-hydroxy-naphthalene-3-carboxylic acid-(2'-methoxy-phenyl)-amide (C.I. No. 37 530) were mixed while stirring with a mixture of 40 parts of ethanol, 30 parts of $\beta,\beta'$-dihydroxy diethyl sulfide and 20 parts of 33% sodium hydroxide solution, and the mixture was dissolved by adding 50 parts of water of 70° C. Then, 20 parts of a 40% aqueous dispersion of 4-amino-diphenylamine containing 12.5% of methyl glycol and, as a dispersing agent, 10% of castor oil fatty acid polyglycol ether were diluted with 80 parts of water.

With 400 parts of a 6% aqueous thickener of a locust bean flour ether, diluted with 300 parts of water, first the naphthol solution, then the dilute amine dispersion and finally a solution of 30 parts of sodium nitrite in 40 parts of water were blended.

With this printing paste, a bleached and mercerized cotton fabric was printed on a screen printing machine. After having been dried, the material was impregnated with a cold aqueous 5% solution of monochloroacetic acid (liquor pick-up 80%) on a nipper, and the dyestuff was continuously developed immediately after an air passage of 80 seconds in an alkaline bath of 80° C, which contains 12 g/l of anhydrous sodium carbonate. After the usual aftertreatment, a print was obtained having a full dark-blue shade of high tinctorial strength with the known good fastness properties.

EXAMPLE 3

20 Parts of 2-hydroxy-naphthalene-3-carboxylic acid-(2'-ethoxy-phenyl)-amide (C.I. No. 37 558) were dissolved in a mixture of 16 parts of ethanol, 30 parts of β.β'-dihydroxy diethyl sulfide, 16 parts of 33% sodium hydroxide solution and 40 parts of water of 40° C, and the solution was diluted with 200 parts of water.

With 400 parts of an 8% thickener of a nonionic locust bean flour ether, first this naphthol solution, then 20 parts of a dispersion of 4-nitro-2-amino-anisole (composition as in Example 2), which had been diluted with water at a ratio of 1:5, and finally a solution of 20 parts of sodium nitrite in 40 parts of water were blended.

With this printing paste, a bleached and causticized cotton poplin fabric was printed on the usual roller printing machine, and dried. The dried material was again passed through the same printing machine and cross-printed with a slightly thickened aqueous 25% solution of lactic acid/glycolic acid (1:1) by means of a stipping roller, and after an air passage of 120 seconds it was developed in a bath of 25° C containing 15 g/l of anhydrous sodium carbonate. The aftertreatment corresponded to that of Example 1. A scarlet print of high tinctorial strength having fastness properties usual for a combination of C.I. No. 37 558 / C.I. No. 37 130 was obtained.

EXAMPLE 4

15 Parts of 2-hydroxy-naphthalene-3-carboxylic acid-phenyl amide (C.I. No. 37 505) were mixed while stirring with 25 parts of ethanol, 30 parts of β,β'-dihydroxyethyl sulfide and 20 parts of 33% sodium hydroxide solution, and the mixture was dissolved by adding 100 parts of water of 40° C. Then, 30 parts of a 45% dispersion of 4-amino-4-methoxy-diphenylamine in water-/ethylene glycol (with 14% of a lignin sulfonate as the dispersing agent) were diluted with 100 parts of water.

With 400 parts of a 5% aqueous thickener of a locust bean flour ether, first a solution of the coupling component, then the dilute amine dispersion and finally a solution of 25 parts of sodium nitrite in 40 parts of water were blended.

This printing paste was transferred onto a bleached and mercerized cotton fabric by means of a flat screen printing machine. After having been dried, the material was slop-padded on a preceding padding machine with a cold aqueous solution of 40 g/l of monochloroacetic acid, 10 g/l of formic acid (85%) and 150 g/l of sodium chloride, and after an air passage of 120 seconds, it was developed continuously in a bath of 75° C, containing 10 g/l of anhydrous sodium carbonate.

After the usual aftertreatment, a deep blue print of high tinctorial strength having the fastness properties usual with this combination was obtained.

EXAMPLE 5

A mixture of 15 parts of 2-hydroxy-naphthalene-3-carboxylic acid naphthylamide (C.I. No. 37 600) and 5 parts of 5-chloro-2-acetoacetylamino-1,4-dimethoxy-benzene (C.I. No. 37 613) was mixed while stirring with 25 parts of ethanol, 30 parts of butyl diglycol and 23 parts of 33% sodium hydroxide solution, and the mixture was dissolved by adding 100 parts of water of 60° C. This solution was blended while stirring with 400 parts of a 5% aqueous thickener of a locust bean flour ether, and then 20 parts of the dianisidine dispersion described in Example 1 and diluted with 70 parts of water, and a solution of 20 parts of sodium nitrite in 40 parts of water were added. By adding 250 parts of water, the required viscosity was reached.

With this printing paste, a bleached cotton tricot fabric was printed on a planographic printing machine and dried. Then the printed and dried material was slop-padded with a 20% aqueous solution of monochloroacetic acid on a two-roller padder and after an air passage of 60 seconds, developed continuously in a bath of 70° C containing 12 g/l of anhydrous sodium carbonate.

After the usual rinsing and soaping operations, a print having a full black shade of high fastness to light and the usual general fastness properties was obtained.

EXAMPLE 6

A solution of 20 parts of 2-hydroxynaphthalene-3-carboxylic acid phenyl amide (C.I. No. 37 505) in 32 parts of ethanol, 40 parts of water and 20 parts of a 33% sodium hydroxide solution was mixed while stirring with 400 parts of a 5% aqueous thickener of a locust bean flour ether and 300 parts of water. Then, 20 parts of a 50% dispersion of 4-amino-diphenylamine in water-/ethylene glycol (1:1) with 10% of the polyglycol ether of the formula

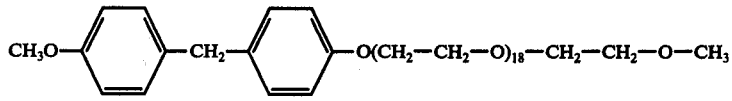

as a dispersing agent, which had been diluted with 100 parts of water, and then a solution of 20 parts of sodium nitrite in 30 parts of water were added.

With this printing paste, a bleached and mercerized cotton fabric was printed on a screen printing machine. After drying in a drying cabinet attached to the printing machine, the fabric was sprayed with a cold aqueous 30% solution of monochloroacetic acid up to a liquor pick-up of 20% in an electrostatic spraying device, and after an air passage of about 90 seconds, it was developed continuously in an alkaline bath of 80° C, containing 10 g/l of anhydrous sodium carbonate. After the usual rinsing and soaping operations, a print of a deep navy-blue shade was obtained of high tinctorial strength with the good fastness properties known for this combination.

We claim:

1. A process for printing cellulosic textile material with a printing paste containing
   a. the alkaline solution of a coupling component capable of forming developing dyes,
   b. the dispersion of a diazotable amine capable of forming developing dyes,
   c. sodium nitrite and
   d. a thickener, which process comprises developing the dyestuff on the fiber by adding a dilute aqueous solution of an organic acid of which at least 30 g are soluble in 100 g water, having at 20° C a pK value of 4 to 2.5 and at normal pressure a boiling point above 175° C, followed by a short air passage and a subsequent contact with an alkaline agent.

2. A process as claimed in claim 1, wherein the cellulosic material consists predominantly or entirely of cellulose fibers.

3. A process as claimed in claim 1, wherein the printing paste contains additionally a soluble leuko sulfuric acid ester vat dye.

4. A process as claimed in claim 1, wherein the coupling component has a low or medium substantivity.

5. A process as claimed in claim 4, wherein the coupling component is an arylamide of acetoacetic acid, 2-hydroxy-3-naphthoic acid or of a heterocyclic orthohydroxy carboxylic acid.

6. A process as claimed in claim 1, wherein the coupling component is 2-hydroxynaphthalene-3-carboxylic acid phenylamide which is unsubstituted or substituted in the phenyl nucleus by halogen, lower alkyl or lower alkoxy.

7. A process as claimed in claim 1, wherein the amine is not or only scarcely volatile with steam.

8. A process as claimed in claim 7, wherein the amine is a nitroaniline, an anthranilic acid amide, an aniline sulfonic acid amide, an aminobenzonitrile, a benzoyl phenylene diamine or a diamino-biphenyl.

9. A process as claimed in claim 1, wherein the organic acid is a monohydroxy monocarboxylic acid, a dihydroxy dicarboxylic acid, a monohydroxy tricarboxylic acid or a haloalkanoic acid each having up to 3 carbon atoms in their skeleton to which the carboxy groups are bound.

10. A process as claimed in claim 1, wherein the air passage lasts about 0.5 to 3 minutes.

11. A process as claimed in claim 10, wherein the period of time is 1 to 2 minutes.

12. A process as claimed in claim 1, wherein contacting with an alkaline agent is effected by passing the dyed or printed fabric through an alkaline solution or through an alkaline gas.

13. A process as claimed in claim 12, wherein contacting with the alkaline agent effects a pH of 7 to 8 on the fabric.

14. A process as claimed in claim 12, wherein the alkaline solution has a temperature of 70° to 80° C.

15. A process as claimed in claim 12, wherein the alkaline solution is an aqueous solution of sodium carbonate, trisodium phosphate or ammonia.

16. A process as claimed in claim 12, wherein the alkaline gas is ammonia or a volatile amine.

* * * * *